US007424248B2

(12) United States Patent
Azumi et al.

(10) Patent No.: US 7,424,248 B2
(45) Date of Patent: Sep. 9, 2008

(54) LOCK MECHANISM FOR OPENING AND CLOSING MEMBER AND IMAGE FORMING APPARATUS

(75) Inventors: Shinichi Azumi, Nara (JP); Kouji Yamaji, Kyoto (JP); Akira Kohno, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/553,207

(22) PCT Filed: Apr. 5, 2004

(86) PCT No.: PCT/JP2004/004918

§ 371 (c)(1),
(2), (4) Date: Oct. 13, 2005

(87) PCT Pub. No.: WO2004/092846

PCT Pub. Date: Oct. 28, 2004

(65) Prior Publication Data

US 2006/0269319 A1 Nov. 30, 2006

(30) Foreign Application Priority Data

Apr. 16, 2003 (JP) ..... 2003-111866

(51) Int. Cl.
*G03G 21/00* (2006.01)

(52) U.S. Cl. ..... 399/124; 399/110

(58) Field of Classification Search ..... 399/110, 399/124, 125, 114

See application file for complete search history.

(56) References Cited

U.S. PATENT DOCUMENTS 5,485,249 A * 1/1996 Higeta et al. ..... 399/110
6,219,508 B1 * 4/2001 Nagatomi et al. ..... 399/125
6,394,300 B1 * 5/2002 Bosy ..... 292/DIG. 11
6,568,723 B2 * 5/2003 Murphy et al. ..... 292/DIG. 38
6,595,605 B1 * 7/2003 Babcock et al. ..... 292/87

FOREIGN PATENT DOCUMENTS

| | | | |
|---|---|---|---|
| JP | 6-45025 | U | 6/1994 |
| JP | 10-123910 | A | 5/1998 |
| JP | 2000-79739 | A | 3/2000 |

OTHER PUBLICATIONS

English machine translation of JP 2000-079739 A.*

* cited by examiner

*Primary Examiner*—David M. Gray
*Assistant Examiner*—Laura K Roth
(74) *Attorney, Agent, or Firm*—Birch, Stewart, Kolasch & Birch, LLP

(57) ABSTRACT

A lock mechanism includes an opening and closing member (10) that is openably and closably provided on an apparatus frame (1*a*), a shaft member (15) that is provided on the apparatus frame (1*a*) for rotatably supporting the opening and closing member (10), and three lock member sets (13) and (14) for sustaining a state in which the opening and closing member (10) is closed with respect to the apparatus frame (1*a*). The lock member sets (13) and (14) include secured members (13) provided on the opening and closing member (10), and bearing members (14) that are provided on the apparatus frame (1*a*) for elastically securing the secured members (13). The elastic force when a secured member (132) in one specific lock member set is secured to a bearing member (142) is set to be greater than that of the other lock member sets (131), (133), (141), and (143).

7 Claims, 5 Drawing Sheets

LOCK MECHANISM FOR OPENING AND CLOSING MEMBER AND IMAGE FORMING APPARATUS

TECHNICAL FIELD

The present invention relates to a lock mechanism for an opening and closing member provided in, for example, image forming apparatuses such as various types of copiers, printing apparatuses and facsimile apparatuses, AV machines, and other office equipment. Further, the present invention relates to image forming apparatuses provided with the lock mechanism.

BACKGROUND ART

Image forming apparatuses such as printers and copiers are usually configured such that it is possible to open and close a part of their housing frame, and thus the inner portion is accessible when necessary, for example, when changing supply products such as ink and toner, when removing printing paper jammed inside the apparatus, or when performing maintenance.

Inside the apparatus, a high voltage is used for transfer, a fixing portion is heated to a high temperature, and various types of functional components rotate and move complexly in conjunction with one another. Therefore, an opening and closing member is provided with an interlock switch to monitor a state of opening and closing the opening and closing member, for the purpose of preventing trouble caused when the operator carelessly accesses inside the apparatus.

However, in order to improve work efficiency when changing supply products, handling jammed materials, and performing maintenance, image forming apparatuses such as printers and copiers tend to have a large opening portion. Accordingly, the opening and closing member is large, and it is necessary to operate a plurality of lock member sets in order to close the opening and closing member, so that the operation is significantly complicated.

In order to address the above-described problem, for example, a lock mechanism has been proposed in which engagements of a plurality of secured hooks on a door member with engagement portions on a mainframe are simultaneously released by operating one button and in which the plurality of secured hooks on the door member can be simultaneously engaged with the engagement portions on the mainframe by closing the door member (see JP H06-45025U (Paragraph Nos. [0015] to [0024], and FIG. 12), for example).

In this configuration, the plurality of secured hooks are pivotably supported with respect to the door member, and the engagement portions for securing the secured hooks are attached to the mainframe via a rotatable shaft.

However, in the configuration described in JP H06-45025U, the number of the components is large because the secured hooks and the engagement portions constituting the lock mechanism are formed separately from the door member and the mainframe, and pivoting portions and rotating portions make the configuration significantly complex, so that there is the problem that the apparatus becomes large and the manufacturing cost is high.

The present invention was made in view of the above circumstances, and it is an object thereof to provide a lock mechanism, for an opening and closing member, that has a good operability and a simple configuration, and an image forming apparatus provided with the lock mechanism.

DISCLOSURE OF THE INVENTION

The present invention is characterized by an opening and closing member that is provided on an apparatus frame and that can be opened and closed, and at least two lock member sets for sustaining a state in which the opening and closing member is closed with respect to the apparatus frame, wherein each of the at least two lock member sets is constituted by a secured member that is provided on the opening and closing member, and a bearing member that is provided on the apparatus frame and that is to elastically secure the secured member, and wherein an elastic force when the secured member in any one lock member set of the at least two lock member sets is secured to the bearing member is set to be greater than that of the other lock member set.

In this configuration, the elastic force when securing any one lock member set (specific lock member set) of the at least two lock member sets is set to be greater than that of the other lock member set, and thus the other lock member set can be locked following a one-touch operation in which the specific lock member set is pressed once to be locked. Accordingly, the work efficiency when locking the opening and closing member can be significantly improved.

The secured members of the lock member sets are provided, for example, on the opening and closing end of the opening and closing member. The secured member of the specific lock member set is disposed at a substantially center position in the direction perpendicular to the opening and closing direction of the opening and closing member. In this configuration, when the lock member set with the greatest elastic force is provided in the center of the opening and closing member, the other lock member set can be locked in a well-balanced manner following the one-touch operation in which the lock member set is pressed once to be locked, and thus the operability is improved.

The number of lock member sets may be, for example, three. In this configuration, for example, when the elastic force of the lock member set in the center is set to be greatest, the lock member sets on both sides can be locked with the one-touch operation in which the lock member set is locked, and thus the operability is improved.

BEST MODE FOR CARRYING OUT THE INVENTION

Hereinafter, a lock mechanism of an opening and closing member and an image forming apparatus according to an embodiment of the present invention are described with reference to the drawings.

Figure 1:
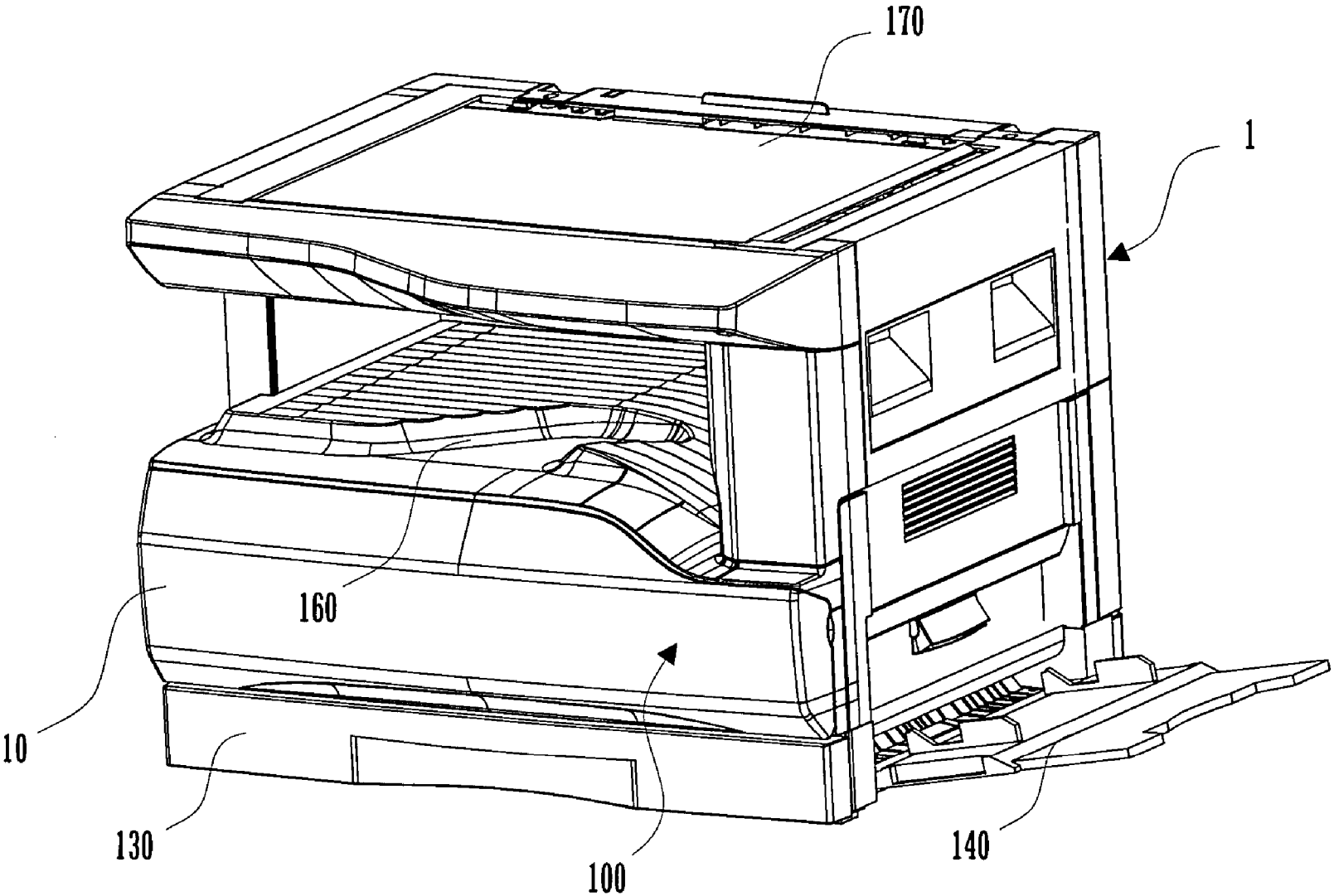
FIG. 1 is a perspective view of an image forming apparatus according to an embodiment of the present invention.

As shown in FIG. 1, a document platen 170 that is made of, for example, transparent glass is provided on the upper face of an image forming apparatus 1 according to this embodiment of the present invention. An optical system for reading a document is disposed below the document platen 170. The optical system is constituted by an exposure light source for irradiating light on a document placed on the document platen 170 and a plurality of reflection mirrors for guiding the light to an imaging lens and a photoelectric transducer (hereinafter, referred to as "CCD"). An image on the document is read by moving and activating the exposure light source and the reflection mirrors.

An automatic document feeder (not shown) for automatically transporting and reading the document is disposed above the document platen 170, and it is possible to read the document when the document is moving or when the document is temporarily stopped on the document platen 170. Furthermore, it is also possible to automatically read a double-sided printed document by providing a duplex automatic document feeder.

In an image forming portion 100, document image data that has been read by the CCD undergoes image processing performed with a control circuit (not shown) or other components, and then is irradiated, as laser light, on the surface of an image bearing member (hereinafter, referred to as "photosensitive member") with a laser scanning unit (hereinafter, referred to as "LSU"), to form a latent electrostatic image.

The photosensitive member is formed in the shape of a drum and is rotatively driven. A developing device for developing, with toner, the latent electrostatic image on the surface of the photosensitive member to be a visible image, a transfer charger for transferring the toner image on the photosensitive member to paper, a cleaning device for removing toner remaining on the surface of the photosensitive member, a charger for charging the surface of the photosensitive member to a predetermined potential, and an LSU for irradiating a laser toward a laser irradiation point of the photosensitive member are arranged in this order around the photosensitive member.

Further, paper is held in a paper cassette 130. A half-moon-shaped roller for sending paper onto a paper feeding transport path is disposed at the front end portion of the paper cassette 130, and paper is thus transported toward the downstream side in the transport direction. It is also possible to set paper in a manual tray 140. A pick-up roller for feeding paper and a sending roller for sending the fed paper onto a paper feeding transport path are arranged at the front end portion of the manual tray 140, and paper is thus transported toward the downstream side in the transport direction.

A pre-registration detection switch for detecting that paper fed from the paper cassette 130 or the manual tray 140 passes through, a PS roller for adjusting the position of a toner image on the photosensitive member and that of the paper based on a signal from the pre-registration detection switch, fixing rollers for letting the toner image on the paper be fixed on the paper using a heating roller and a pressing roller, a fixed paper detection switch for detecting that the paper has passed through the fixing rollers, a discharged paper detection switch for detecting that the paper has passed through on a paper discharging transport path, and a discharge roller for discharging the paper are arranged.

An image forming process series is completed when paper is sent from the paper cassette 130 to pass through the above-described components, an image is formed and then fixed on the paper, and the paper is discharged to a paper discharge tray 160.

The front side of the image forming apparatus 1 is provided with an opening and closing door (opening and closing member of the present invention) 10 in order to supply developer, to perform maintenance of the apparatus, or to remove recording paper, for example, when the recording paper is jammed during an image formation. The inner portion of the apparatus is provided with an interlock switch for detecting a state of opening and closing the opening and closing door 10, in order to prevent danger to the operator, such as a high voltage, a high temperature, and the operation of mechanical components. When a state in which the opening and closing door 10 is open has been detected, the flow of electricity inside the apparatus and the operation of the apparatus are regulated to secure the safety of the operator.

Figure 2:
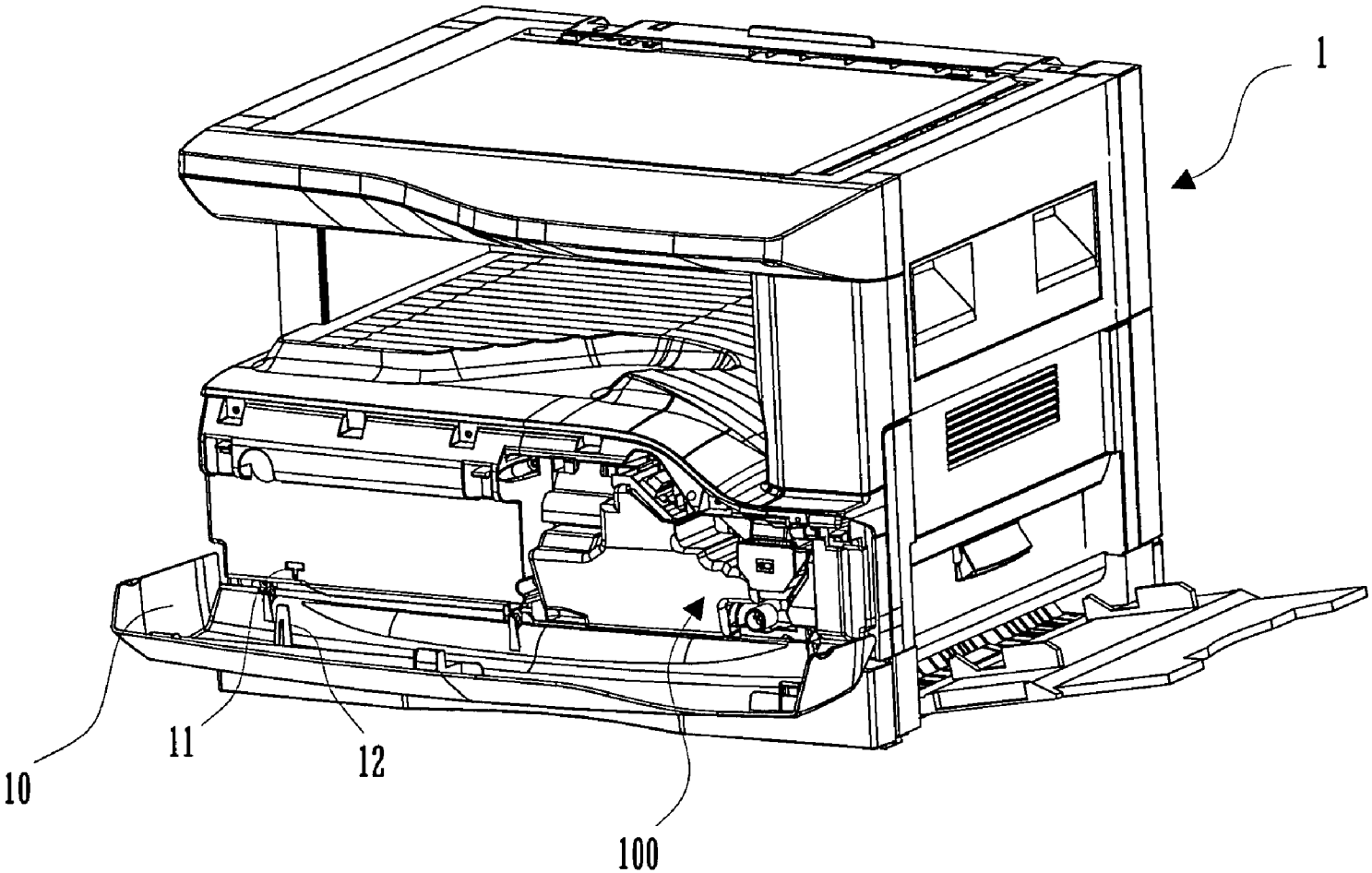
FIG. 2 is a perspective view showing a state in which an opening and closing member of the image forming apparatus is open.

Next, FIG. 2 shows a state in which the opening and closing door 10 of the image forming apparatus 1 is open. When the opening and closing door 10 is open, a photosensitive drum, a developing portion, a charging portion, a transferring portion, and a fixing portion constituting the image forming portion 100 can be accessed, and thus maintenance work can be performed. Furthermore, the apparatus frame is provided with an interlock switch 11 and detects that the opening and closing door 10 is closed when a protrusion 12 provided on the opening and closing door 10 is inserted in the interlock switch 11.

Figure 3A:
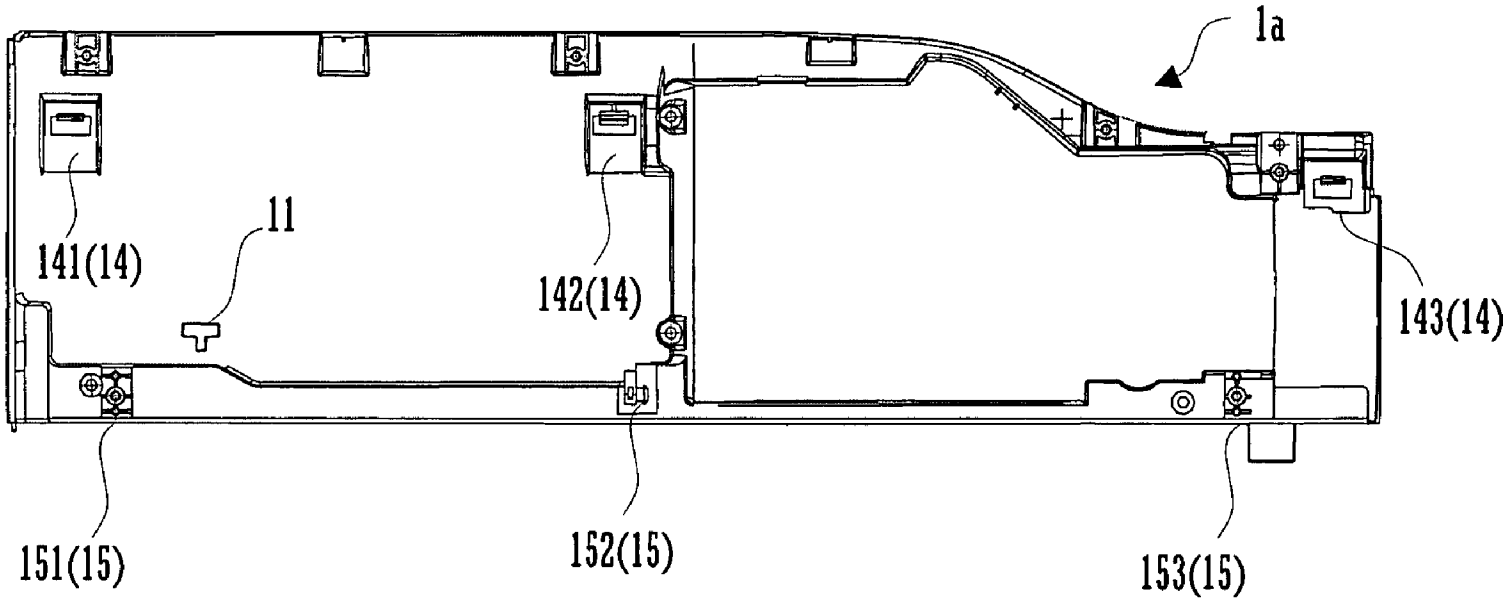
FIGS. 3A and 3B are explanatory diagrams showing the relationship between an apparatus frame and the opening and closing member of the image forming apparatus.
Figure 3B:
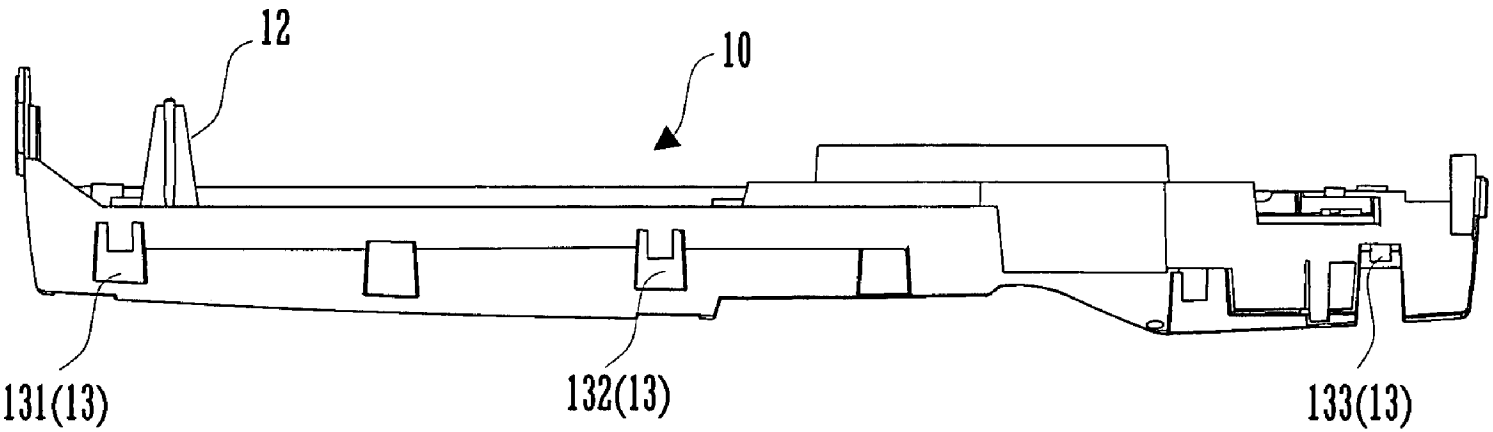

FIGS. 3A and 3B show the relationship between the opening and closing door 10 and an apparatus frame 1*a*. FIG. 3A is a front view of an opening and closing portion, in the apparatus frame 1*a*, to which the opening and closing door 10 is attached. FIG. 3B is a view of the opening and closing door 10 when viewed from the above, and the opening and closing door 10 can be rotated in the left direction of the drawing about an axis (not shown).

The inner side of the upper portion of the opening and closing door 10, serving as an opening and closing end, is provided with three secured members 13 (131, 132, and 133) arranged side by side with predetermined intervals therebetween in the direction perpendicular to the opening and closing direction. When closing the opening and closing door 10, the secured members 13 are respectively secured to bearing members 14 (141, 142, and 143) provided on the components of the apparatus frame 1*a*, so that the opening and closing door 10 is locked. It should be noted that the secured members 13 (131, 132, and 133) and the bearing members 14 (141, 142, and 143) constitute the lock member sets of the present invention.

An elastic force when securing one (specific) secured member 132 disposed in the center is set to be greater than that of the other secured members 131 and 133. Accordingly, the other secured members 131 and 133 are secured to the bearing members 141 and 143 following a one-touch operation in which the secured member 132 is secured to the bearing member 142 on the apparatus frame 1*a*, and the opening and closing door 10 is completely closed with respect to the apparatus frame 1*a* and is locked therewith.

Further, as for the opening and closing door 10, its lower portion is rotatably supported by shaft members 15 (151, 152, and 153) (see FIGS. 4 and 5) arranged on three lower portions of the apparatus frame 1*a*, and its upper portion serves as the opening and closing end. The apparatus frame 1*a* is provided with the interlock switch 11 for detecting a state in which the opening and closing door 10 is open, so that, in a state in which the opening and closing door 10 is closed, it is possible to confirm that the opening and closing door 10 is closed when the protrusion 12 provided on the inner side of the lower portion of the opening and closing door 10 is inserted in the interlock switch 11.

Figure 4C:
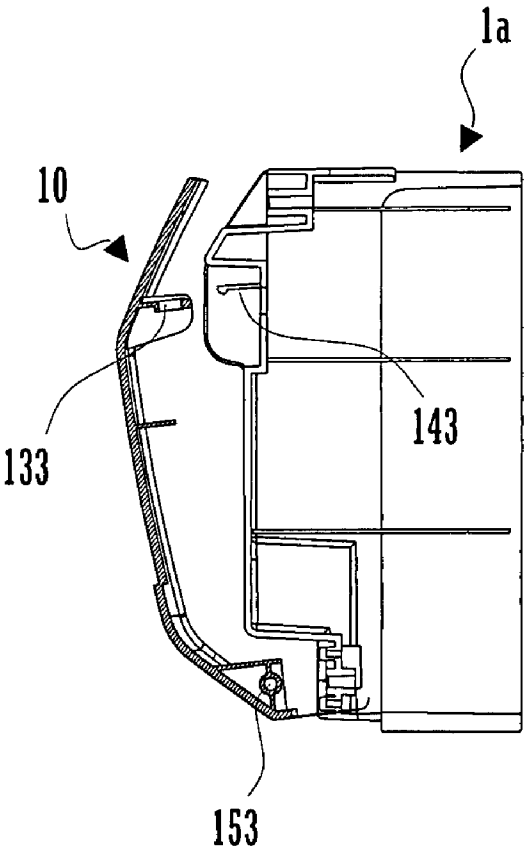
FIGS. 4A-4C are explanatory diagrams showing a state in which a secured member in the center of the opening and closing member abuts against a bearing member.
Figure 4B:
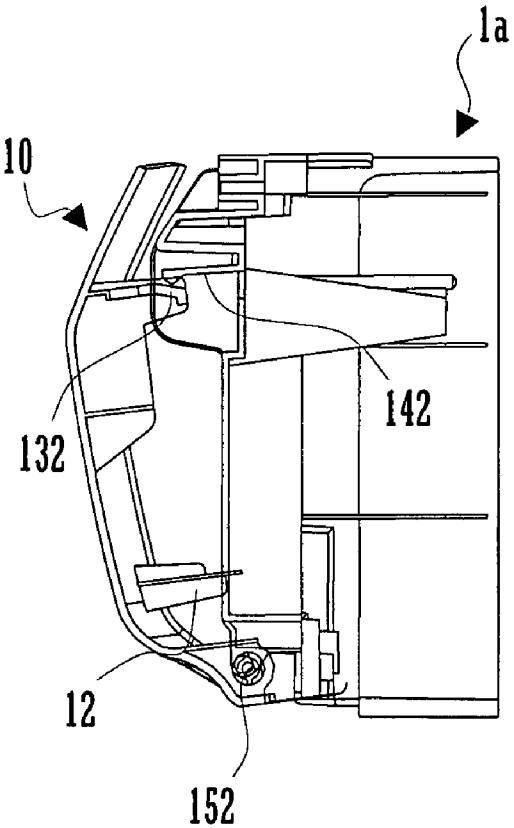
Figure 4A:
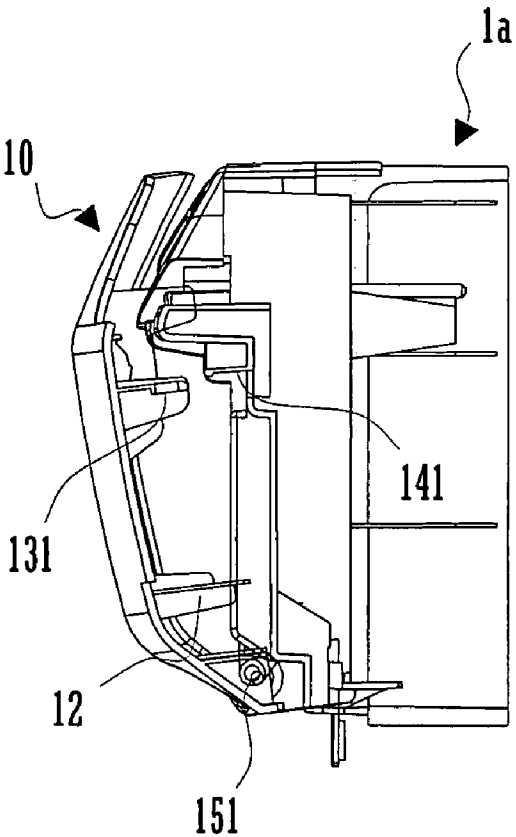

FIGS. 4A-4C show a state directly before closing the opening and closing door 10 with respect to the apparatus frame 1*a*. FIG. 4A shows the state of the left side, FIG. 4B shows the center, and FIG. 4C shows the right side. In the state shown in the drawings, the opening and closing door 10 is open by seven degrees, the bearing member 142 in the center on the side of the apparatus frame 1*a* and the secured member 132 in the center of the opening and closing door 10 abut against each other, and the secured members 131 and 133 do not abut against the other bearing members 141 and 143.

In this state, when the center portion of the opening and closing door 10 is pressed in the right direction of the drawing, the secured member 132 is secured to the bearing member 142, and the other secured members 131 and 133 follow the one-touch operation to be secured to the respective bearing members 141 and 143, so that the opening and closing door 10 is completely closed and locked as shown in FIG. 5. In this locked state, the protrusion 12 is inserted in the interlock switch 11, and thus it is detected that the opening and closing door 10 is closed.

In this manner, the elastic force of the center secured member 132 is set to be greater than that of the other secured members 131 and 133, and a relative space between the front end of the secured member 132 and the bearing member 142 is set to be smaller than relative spaces between the front ends of the other secured members 131 and 133 and the bearing members 141 and 143, so that when closing the opening and closing door 10, the opening and closing door 10 can be completely locked with the one-touch operation of pressing the center secured member 132 as described above.

Figures 5A, 5B, 5C:
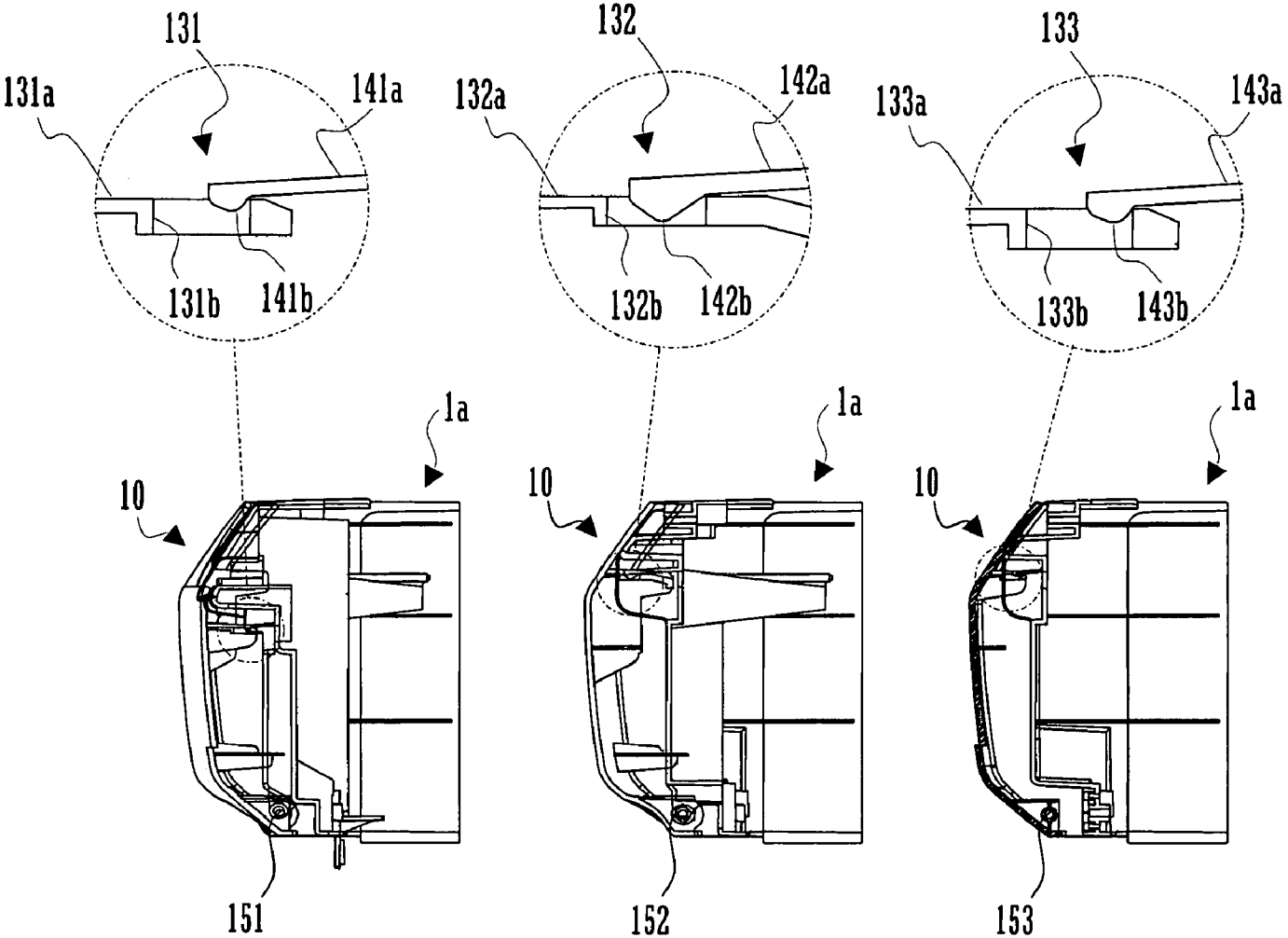
FIGS. 5A-5C are explanatory diagrams showing a state in which the opening and closing member is locked.

In this embodiment, as enlarged and shown in FIGS. 5A-5C, the secured members 13 have through hole portions 131*b*, 132*b*, 133*b* at the front ends of support arms 131*a*, 132*a*, 133*a* projecting on the inner side of the opening and closing door 10, and the bearing members 14 have downward convex portions 141*b*, 142*b*, 143*b*, which are substantially in the form of a cone and which can be fitted in the hole portions 131*b*, 132*b*, 133*b*, and can be secured to the front ends of support arms 141*a*, 142*b*, 143*b* projecting on a component (a frame or a panel, for example) of the apparatus frame 1*a*. In order to release the locked state of the lock member sets, it is possible to release the locked state and open the opening and closing door 10 by touching both ends of the opening and closing door 10 and applying a force equal to or greater than a predetermined force in the opening direction, and thus no additional member for releasing the lock is required.

The lock member sets can be easily formed in one piece with components of the opening and closing door 10 and the apparatus frame 1*a* by integrally molding, it is easy to set the elastic force for them, they do not require any additional component, and they can be provided at a low price. For example, the elastic force can be increased by increasing the thickness or width of the support arms 131*a*, 132*a*, 133*a* or the support arms 141*a*, 142*a*, 143*a* The securing force can be increased by increasing the projecting amount or the outer diameter of the convex portions l4l*b*, 142*b*, 143*b*, for example.

Furthermore, the secured members 13 and the bearing members 14 may have configurations opposite to those in the drawings. The configuration of the lock member sets is not limited to the configuration shown in the drawings, and any configuration may be adopted as long as the lock member sets can be elastically locked with a one-touch operation and they can be formed in one piece with components of the opening and closing door 10 and the apparatus frame 1*a* by integrally molding.

Furthermore, the present invention does not limit the configuration of the image forming apparatus 1 to that shown in FIG. 1, and the present invention may be applied to any system or configuration that is provided at least with an image bearing member on which an image is formed based on image information and an opening and closing member for opening and closing at least a part of the apparatus frame.

Furthermore, the present invention does not limit the position of the opening and closing member to a position on the front side, and the opening and closing member may be provided, for example, on the side or rear side. Further, it goes without saying that such a lock mechanism for an opening and closing member can be provided not only in image forming apparatuses, but also in AV machines and various types of office equipment, for example.

According to the present invention, the elastic force when securing one specific lock member set is set to be greater than that of the other lock member sets. Thus, the other lock member sets can be locked following a one-touch operation in which the specific lock member set is pressed once to be locked. Accordingly, it is possible to significantly improve the operability when locking the opening and closing member.

Further, the opening and closing member can be effectively locked by providing the secured members on the opening and closing end side of the opening and closing member.

Further, in the present invention, any one lock member set of a plurality of lock member sets may be the lock member set with the greatest elastic force. When the lock member set with the greatest elastic force is provided in the center of the opening and closing member, the other lock member sets can be locked in a well-balanced manner following the one-touch operation in which the lock member set is pressed once to be locked, and thus the operability is improved.

When a relative space between the front end of the secured member and the bearing member in one specific lock member set is set to be smaller than relative spaces between the front ends of the secured members and the bearing members in the other lock member sets, such that the specific secured member is secured to the bearing member first when closing the opening and closing member, the other lock member sets can be easily locked following the operation in which the secured member in the lock member set with the greatest elastic force is secured to the bearing member before the other lock member sets.

The embodiments described above are to be considered in all respects as illustrative and not limiting. The scope of the invention is indicated by the appended claims rather than by the foregoing embodiments. Furthermore, all changes which come within the meaning and range of equivalency of the claims are intended to be embraced in the scope of the invention.

The invention claimed is:

1. A lock mechanism for an opening and closing member, comprising:

an opening and closing member that is provided on an apparatus frame and that can be opened and closed, the opening and closing member having an opening and closing axis proximate one side of the opening and closing member; and at least two lock member sets for sustaining a state in which the opening and closing member is closed with respect to the apparatus frame, wherein each of the at least two lock member sets is constituted by a secured member that is provided on the opening and closing member, and a bearing member that is provided on the apparatus frame and that is to elastically secure the secured member, wherein the bearing members of each of the at least two lock member sets are provided on a common side of the apparatus frame, an elastic force when the secured member in any one lock member set of the at least two lock member sets is secured to the bearing member is set to be greater than that of the other lock member set, the at least two lock member sets are provided at a second side of the opening and closing member, opposed to the one side, the at least two lock member sets are arranged so that each lock member set is aligned in a line approximately along a width direction of the opening and closing member, in one lock member set, the secured member comprises a through hole portion and the bearing member has a downward convex portion to engage the through hole portion, and the secured member, in the any one lock member set, secured to the bearing member with the greater elastic force is disposed at a substantially center position in a direction perpendicular to an opening and closing direction of the opening and closing member.

2. The lock mechanism for an opening and closing member according to claim 1, wherein the secured members in the lock member sets are provided on an opening and closing end side of the opening and closing member.

3. The lock mechanism for an opening and closing member according to claim 2, wherein the at least two lock member sets are three lock member sets.

4. The lock mechanism for an opening and closing member according to claim 1, wherein a relative space between a front end of the secured member and the bearing member in the any one lock member set is set to be smaller than relative spaces between a front end of the secured member and the bearing member in the other lock member set, and wherein the any one secured member is secured to the bearing member first when closing the opening and closing member.

5. The lock mechanism for an opening and closing member according to claim 1, wherein the secured members are formed in one piece with the opening and closing member by integrally molding.

6. The lock mechanism for an opening and closing member according to claim 1, wherein the bearing members are formed in one piece with the apparatus frame by integrally molding.

7. An image forming apparatus, comprising:

an image forming apparatus frame provided with a document platen on which a document is placed, an optical system for creating image data by reading the document placed on the document platen, an image bearing member for bearing a latent electrostatic image corresponding to the image data read by the optical system, a developing device for forming a toner image by changing, with toner, the latent electrostatic image on the image bearing member into a visible image, and a transferring device for transferring the toner image on the image bearing member, which has been changed into a visible image with the developing device, to paper;

an opening and closing member that is provided on the image forming apparatus frame and that can be opened and closed; and at least two lock member sets for sustaining a state in which the opening and closing member is closed with respect to the image forming apparatus frame, wherein each of the at least two lock member sets is constituted by a secured member that is provided on the opening and closing member, and a bearing member that is provided on the image forming apparatus frame and that is to elastically secure the secured member, and wherein an elastic force when the secured member in any one lock member set of the at least two lock member sets is secured to the bearing member is set to be greater than that of the other lock member set, and the secured member, in the any one lock member set, secured to the bearing member with the greater elastic force is disposed at a substantially center position in a direction perpendicular to an opening and closing direction of the opening and closing member.

* * * * *